US011127256B2

(12) United States Patent
Davis

(10) Patent No.: US 11,127,256 B2
(45) Date of Patent: Sep. 21, 2021

(54) METHOD AND SYSTEM FOR HEADS UP GAME TOURNAMENT

(71) Applicant: Malcolm B. Davis, Dallas, TX (US)

(72) Inventor: Malcolm B. Davis, Dallas, TX (US)

( * ) Notice: Subject to any disclaimer, the term of this patent is extended or adjusted under 35 U.S.C. 154(b) by 0 days.

(21) Appl. No.: 16/600,939

(22) Filed: Oct. 14, 2019

(65) Prior Publication Data

US 2020/0043295 A1 Feb. 6, 2020

Related U.S. Application Data

(63) Continuation of application No. 15/845,951, filed on Dec. 18, 2017, now Pat. No. 10,445,986, which is a continuation of application No. 14/745,179, filed on Jun. 19, 2015, now Pat. No. 9,846,994.

(60) Provisional application No. 62/015,255, filed on Jun. 20, 2014.

(51) Int. Cl.
*G07F 17/32* (2006.01)

(52) U.S. Cl.
CPC ..... *G07F 17/3279* (2013.01); *G07F 17/3218* (2013.01); *G07F 17/3225* (2013.01); *G07F 17/3293* (2013.01)

(58) Field of Classification Search
CPC ..... G07F 17/3225; G07F 17/3293; G07F 17/3218; G07F 17/3279
See application file for complete search history.

(56) References Cited

U.S. PATENT DOCUMENTS

2005/0173862 A1* 8/2005 Orenstein ..... A63F 1/18 273/292
2006/0121968 A1* 6/2006 Daniel ..... G07F 17/3241 463/16
2007/0126186 A1* 6/2007 Crawford, III ..... G07F 17/32 273/459
2009/0029773 A1* 1/2009 Cherry ..... G07F 17/32 463/42
2010/0062840 A1* 3/2010 Herrmann ..... G07F 17/3223 463/25
2011/0105208 A1* 5/2011 Bickley ..... G07F 17/3239 463/13

(Continued)

*Primary Examiner* — Steve Rowland

(57) ABSTRACT

A method of simulating a heads up gaming tournament utilizing at least one game server and a plurality of personal communication devices includes receiving value from a plurality of participants using the personal communication devices, providing the participants with wagering units, pairing unpaired first and second ones of the participants to play a heads up game, initiating the game by generating a game state, for example, dealing the private cards of a hold'em poker game, and transmitting the game state to the participants for display on the personal communications devices, whereupon the first participant transmits an action to the game server in response to the game state, receiving the action and updating the game state, receiving a second input in response to the first participant's action from the second participant, continuing play until the outcome of the heads up game is determined, updating the number of wagering units held by the first and second participants, repairing the participants for the next game or in the case of poker, the next deal or hand and continuing until all but one of the participants has been eliminated.

18 Claims, 5 Drawing Sheets

(56) References Cited

U.S. PATENT DOCUMENTS

2012/0302332 A1* 11/2012 Buhr ..... A63F 13/795
463/29
2013/0267291 A1* 10/2013 Davis ..... G07F 17/3244
463/13

* cited by examiner

| | BLUE | RED |
|---|---|---|
| CARDS | ♠A ♦K | ♣5 ♣4 |
| BETTING | BLIND BET | RAISE |
| | RAISE | CALL |
| TABLE | ♣A ♣K ♣2 ♠7 ♦7 | |
| BEST HAND | ♣A ♠A ♣K ♦K ♠7 | ♣A ♣K ♣5 ♣4 ♣2 |

| FINISHING PLACE | PAYOUT PERCENTAGE % | PROBABILITY OF FINISHING IN PLACE | PAYOUT FOR POSITION | $P_N * \$_N$ |
|---|---|---|---|---|
| 1st | 33% | 10% | $165,000 | $16,500 |
| 2nd | 20% | 11% | $100,000 | $12,100 |
| 3rd | 15% | 12% | $75,000 | $9,000 |
| 4th | 11% | 12% | $55,000 | $6,600 |
| 5th | 8% | 13% | $40,000 | $5,200 |
| 6th | 7% | 15% | $35,000 | $5,250 |
| 7th | 6% | 17% | $30,000 | $5,100 |
| | | | EV = | $59,750 |

METHOD AND SYSTEM FOR HEADS UP GAME TOURNAMENT

CROSS-REFERENCE TO RELATED APPLICATIONS

This application is a Continuation of U.S. patent application Ser. No. 15/845,951, filed Dec. 18, 2017, and entitled METHOD AND SYSTEM FOR HEADS UP GAME TOURNAMENT, which U.S. patent application Ser. No. 15/845,951 is a Continuation of U.S. patent application Ser. No. 14/745,179, filed Jun. 19, 2015, and entitled METHOD AND SYSTEM FOR HEADS UP GAME TOURNAMENT, now U.S. Pat. No. 9,846,994 issued Dec. 19, 2017, which U.S. application Ser. No. 14/745,179 claims the benefit of U.S. Provisional Application No. 62/015,255, filed Jun. 20, 2014, and entitled METHOD AND SYSTEM FOR HEADS UP GAME TOURNAMENT, the specifications of which are incorporated by reference herein in their entireties.

TECHNICAL FIELD

The following disclosure relates to a method and system for a "heads up" game tournament.

SUMMARY

In one aspect thereof, a method of simulating a heads up gaming tournament utilizing at least one game server and a plurality of personal communication devices includes receiving value from a plurality of participants using the personal communication devices to take part in the tournament, whereby each tournament participant is provided with a plurality of wagering units enabling the participant to participate in the tournament by playing one or more games with one of the personal communication devices. First and second ones of the participants or users are randomly paired to play a heads up game, the heads up game including a random component and a skill based component. A game server initiates the game by generating a game state, for example, dealing the private cards of a hold'em game and the game state is transmitted to the personal communications devices used by the first and second players to interact with the game server and play the heads up game.

The game state is displayed with the personal communications devices whereby the first user transmits an action, for example a bet, to the game server in response to the game state. The first user's action may be used by the game server to update the game state on the users' personal communications devices. A second input is received in response to the first user's action from the second user. The first and second inputs may be one of at least two potentially winning strategies, for example in the case of a poker game, the input could be to raise, fold or call. Play continues until the outcome of the heads up game is determined and the number of wagering units held by the first and second users is updated according. Play continues and participants are eliminated from the tournament when they have exhausted their wagering units.

After a hand or game, the first and second users are repaired, either randomly or with another method that pairs unpaired participants to minimize the amount of time that a participant remains unpaired. In one variation, the amount of time spend by each unpaired participant in the pool of unpaired participants is compare to the amount of time spent by each of other unpaired participants in the pool of unpaired participants, and the two participants with the greatest amount of time in the pool are paired. In an alternate embodiment, unpaired tournament participants may be paired based upon the number of wagering units held by the participants with participants having the smallest number of wagering units being paired. Participants that have just completed a game or hand against each other may be blocked from pairing to prevent participants playing sequential hands or games against the same individual.

In one aspect, a cash out limit is received from one or more participants and the participant's equity is determined after each game and if the participant's equity reaches the cash out limit, the participant is removed from the tournament. The participant removed from the tournament may be provided with the participant's equity in the tournament.

In one embodiment, a method of simulating a heads up poker tournament utilizing at least one game server and a plurality of personal communication devices includes the steps of: a) receiving value from a plurality of participants each having a personal communication device, whereby each participant is provided with a plurality of wagering units enabling the participant to participate in the tournament by playing one or more poker hands with one of the personal communication devices, b) pairing, with the game server, a first unpaired one of the participants with a second unpaired one of the participants to play a heads up poker hand having a random component and skill based component, c) initiating, with the game server, the heads up poker hand with a game state and transmitting the game state to the personal communications devices of the first and second participants for display, d) receiving, with the game server, a first input from the first participant in response to the game state, the input requiring a response from the second participant, e) receiving, with the game server, a second input from the second participant in response to the first input, the second input, the second input being one of at least two different available potentially winning actions, f) determining, with the game server, an outcome of the heads up poker game, g) updating, with the game server, the number of wagering units held by the first and second participant based upon the outcome determined in step f), h) repairing the first and second ones of the participants with unpaired participants other than the first and second participants after the completion of each hand, so long as unpaired participants other than the first and second ones of the participants remain in the tournament; and i) repeating steps c)-h). Players who lose their wagering units may be eliminated after step (g as the tournament progresses.

The method of simulating a game described herein differs from currently utilized tournament formats in that the competition is heads up or one-on-one and is conducted, in the case of poker, one hand at a time. After each hand, the participants are repaired e.g., matched with a different player for the next hand, except in the case where all but two participants have been eliminated. In the case of a simulated heads up poker tournament, the participants are repaired after each game or hand in a manner that minimizes the amount of time a participant is not engaged in a game. Participants may be paired in a manner that prevents or minimizes sequential games between the same participants. In another aspect, participants may be paired and repaired based upon the number of wagering units held by the participants.

BRIEF DESCRIPTION OF THE DRAWINGS

For a more complete understanding, reference is now made to the following description taken in conjunction with the accompanying Drawings in which.

DETAILED DESCRIPTION

Figures 1, 2:
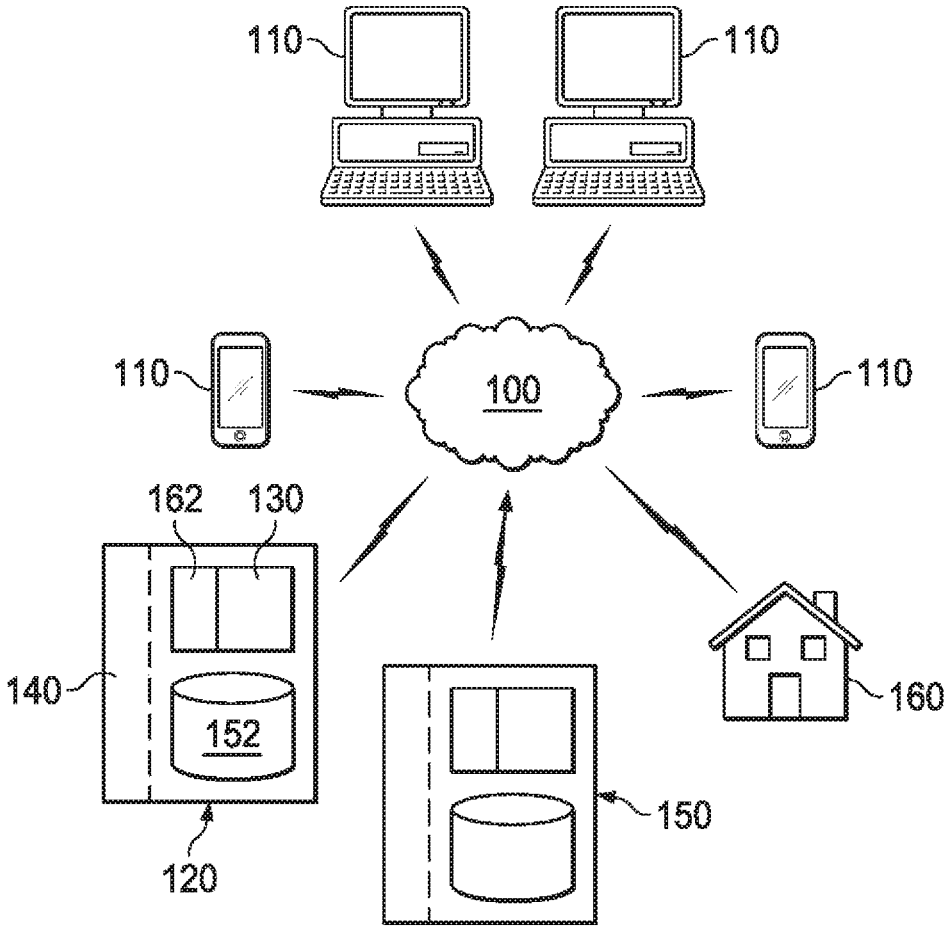
FIG. 1 is a schematic representation of one embodiment of a system for conducting a heads up game tournament.
FIG. 2 illustrates a simplified game of Texas Hold'em poker.

FIG. 1 illustrates a heads up game tournament implemented via a public or private network 100 such as the Internet. As illustrated, players participate in the tournament via personal communications devices 110 such as personal computers, smart phones or similar communication devices. Personal communication devices 110 communicate with a game server 120 having one or more processors 130, communication interfaces 140 and associated databases 152. Game server 120 may utilize communications interface 140 to communicate with a transaction server 150 directly or via a public or private network 100. It is anticipated that personal communications devices 110 will be located remote from game server 120. Conducting the heads up game tournament via personal communications devices 110 enable players at diverse locations remote from game server 110 and other players to participate in the tournament.

In one embodiment, game server 120 provides a website enabling individuals that want to participate in a heads up tournament to log onto the system. Game server 120 may be programmed to enable individuals to open an account for individuals and assign user identification codes and passwords as a means of controlling access to games available via game server 120. Game server 120 may communicate with transaction server 150 to enable players to utilize financial service provider 160, such as a credit card company in order to fund wagers, pay membership, tournament entrance and other fees.

In different embodiments, the tournament game may be poker, for example Texas Hold'em poker. "Texas Hold'em," is generally considered one of the most strategically complex poker variants. Texas Hold'em utilizes a standard 52-card deck and there are typically four betting rounds. In the first round, the players are dealt two private cards. "Blind" bets are used to start the first round. The first player (in the position of the "small blind") typically begins the hand with a set number of units in the pot and the second player (in the position of the "big blind") continues with a bet of 2× the set number of units.

In the second round (or flop), three board or community cards are revealed followed by a betting round. In each of the third round (turn) and fourth round (river), a single board card is revealed followed by a betting round. A fixed-bet maximum may be used, with fixed raise amounts of X units in the first two rounds and Y units in the final two rounds. In other "no-limit" variations, a player may wager as much as he or she wishes in the betting rounds. Following the final round of betting after the river card has been dealt, the winner is determined as the player with the best five card hand (or the last player remaining if all the other players fold) who wins the pot.

A simplified example of a "heads up," (i.e., two player) Hold'em game may proceed as illustrated in FIG. 2. A deck of 52 cards is shuffled (e.g., randomly arranged). Two private cards are dealt to each player (hereafter named Blue and Red). Blue then makes a forced blind bet of one unit. Red then has the options of folding, calling and raising. The betting process based on the private cards may continue until one player folds or calls. The number of raises may be limited to control the pot size and expedite the game. A player loses the pot, e.g., the accumulated bets or wagers, to the opponent if he folds.

Assuming that the betting based on the private cards stops with a call, the five community or common cards, called the table, are dealt as described above. After the river card has been deal, the players each have seven cards, two private and five community cards, from which the best five card hand may be determined. The best five card hand wins the pot. In the example illustrated in FIG. 1, the player designated as "Red" wins three units from the player designated "Blue," because the Red player's flush defeats the Blue player's two pair. Numerous variations and permutations of the game rules are possible.

Referring again to FIG. 1, game server 120 may be programmed to simulate play of a variety of different games suitable for heads up play having a random component and a skill based component. For example, in the case of poker, the random component may be provided by the random selection of cards dealt to a player. The skill based component may be that a given player has a better understanding of the odds associated with a given set of cards and different strategies for playing the cards. The games will also typically involve several stages in each game at which a player may choose from different potentially winning strategies. For example, in a heads up poker tournament, a player may have the option of calling, raising or checking after the initial deal of the private cards and at later stages after the flop, turn and river cards are dealt.

In one embodiment, game server 120 is configured with programed instructions enabling the server to act as an automated dealer. For example, in the case of a poker hand, game server 120 may simulate shuffling a deck of cards to randomly arrange the cards and dealing cards to the players from the randomly arranged deck. Game server 120 may also transmit images of the simulated actions for display on a player's personal communications devices 110. Game server 120 stores player actions such as placing an initial bet, checking, raising, calling a raise or folding a hand and each player's hand or game status after each action at different stages in the game. Game server 120 stores each player's wagering units, the number of wagering units in the pot and, if the game is time-limited, the time at which the last action requiring a responding action occurred.

Figure 4:
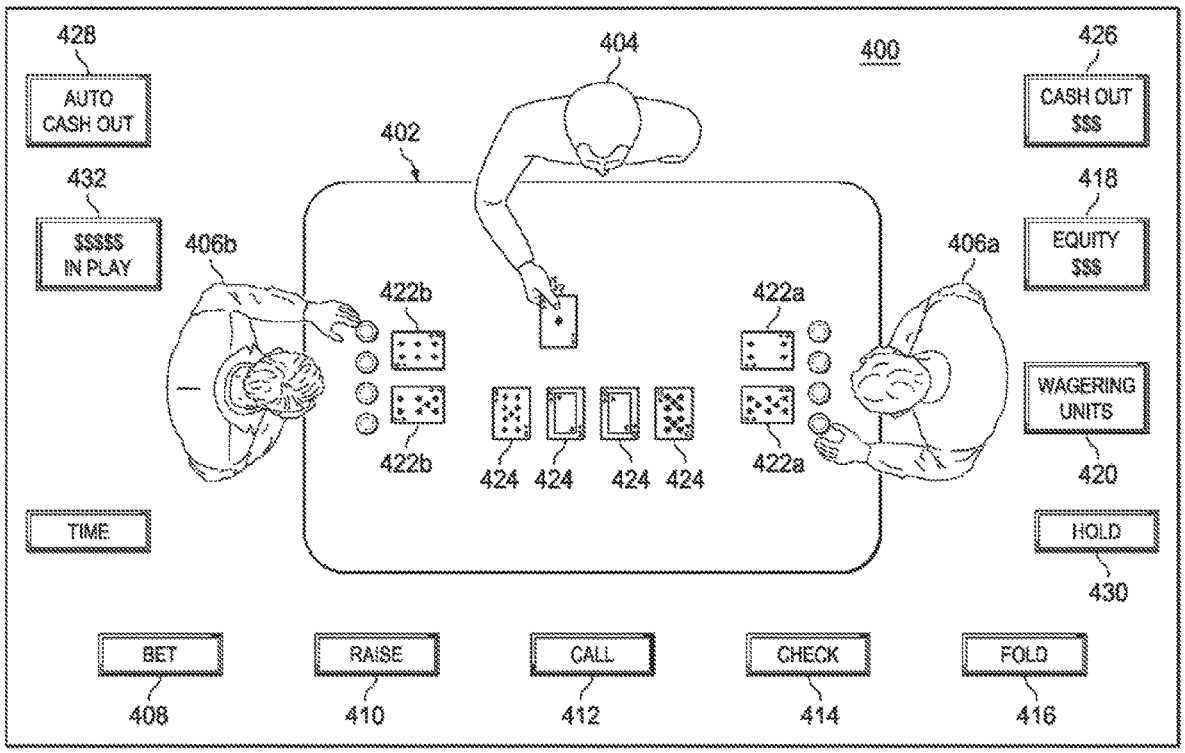
FIG. 4 is a schematic representation of an interactive display for use in one embodiment of a method of conducting a heads up game tournament.

FIG. 4 illustrates one display 400 that may be transmitted by game server 120 for display on a personal communications device 110. Personal communications device 110 may include a graphical user interface, such as a touch screen, that enables a user to view display 400 and take action by touching "buttons" or similar areas of the screen. The display of FIG. 4 shows a simulated game table 402, dealer 404 and players 406*a* and 406*b*. The display of FIG. 4 may show a game state, e.g., the cards held by each player at a given point in the hand or game. Display 400 includes bet, raise, call, check and fold buttons, 408-416 that a player may use to take action. Display 400 also includes an equity display or button 418 and wagering unit number display or button 420 to appraise a player of his or her equity and wagering unit balance. In a heads up hold'em game, tournament players may be represented by simulated players 406*a*, 406*b* with their respective private cards 422*a* and 422*b* displayed only to the individual player with community cards 424 displayed to both players. In the case of a time limited game, display 400 may also include a timer display to inform players as the time remaining for them to take a required action. A "cash out" button 426 may be provided to enable to cash out of the tournament if he or she elects to leave the tournament. Display 400 may also include a display 432 of the total dollars in play in the tournament at any given time to encourage potential players to enter the tournament.

In one variation, a "hold" button 430 may be provided to enable a player to leave the tournament temporarily. For example, a player may decide to leave the tournament for a meal or break. In this embodiment, the "hold" will allow the player to resume play within a predetermined time period. If the player fails to resume play with the predetermined time, he or she may forfeit his or her equity or be automatically cashed out of the tournament. If the player wishes to rejoin the tournament, he or she may be allowed to re-enter the tournament upon payment of an entry fee and/or purchase of a minimum number of wagering units.

Figure 3:
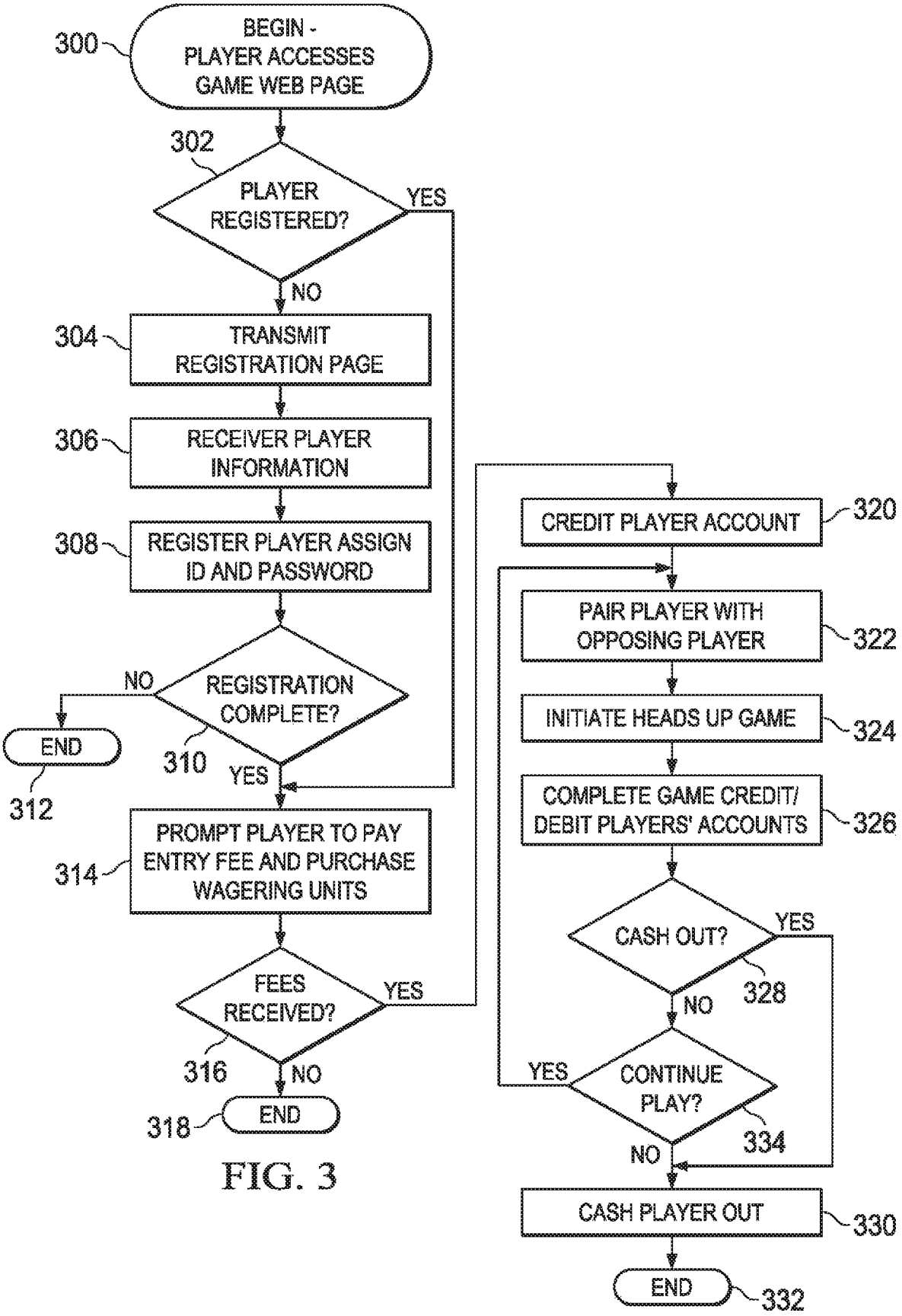
FIG. 3 is a flowchart of one method for conducting a heads up game tournament.

FIG. 3 is a flowchart illustrating one method of conducting a heads up tournament. The process begins at 300 when a player or potential player accesses the game website. Upon accessing the website, at 302 the player may be asked whether he or she is a registered user. If the player is not a registered user, a registration page may be transmitted to the potential player at 304. The player may be required to enter information such as his or her name, address, email, phone number and payment information such as a credit or debit card number or billing address at step 306. After the potential player has entered the required information, he or she may be registered at step 308, assigned a user identification number (ID) and a password enabling the user to access the site and enter a tournament. If the registration is not completed at step 310, for example if the potential player does not provide the required information at 306, the process is terminated at step 312.

At 314 the player or potential player may be prompted to select a particular tournament if multiple tournaments are ongoing. For example, tournaments featuring different games, for example, razz, draw poker, stud poker and hold'em poker may be ongoing at any particular time. The player is prompted to pay an entry fee for the selected tournament (if one is required by the site operator) and purchase wagering units. In some embodiments, payment of an entry fee may entitle a player to a predetermined minimum number of wagering units, in other embodiments a player may have to purchase a predetermined number of wagering units to enter the tournament. In some variations, the player may be permitted to purchase additional wagering units when he or she enters the tournament or as the tournament is ongoing. Typically, the player may be eliminated from the tournament after losing his or her initial pot of wagering units. The player may however, be allowed to re-enter the tournament by paying a second entry fee and/or purchasing a minimum number of wagering units.

If the player pays the fees at 316, the player's account is credited for the entry fee (if any) and for wagering units purchased or included in the entry fee at 320. If the player fails to pay the entry fee and/or purchase a minimum number of wagering units, the process ends at 318. In one embodiment, a player or potential player may purchase as many wagering units as he or she desires. In one embodiment, after the tournament has begun, a player may provide additional funds to obtain additional wagering units during the course of the tournament. In this case, the additional wagering units may be provided to the play without affecting the equity of the remaining tournament participants.

After a player has registered, selected a tournament (if more than one is ongoing), and paid any required entry fee and/or purchased a required minimum number of wagering units, the player is then paired against an opposing player at 322 for a heads up game. In one embodiment, a "free" player, (e.g., one not engaged in a game) is paired with the next available player. Players entering the tournament and players that have just concluded a game may be placed in a pool or group of free or unassigned players. Players in the group of unassigned players are paired in a manner consistent with maximizing the amount of time that players are engaged in a game and minimizing the amount of idle time, (e.g. time when players are not engaged in a game). Thus, in one variation, a first in first out method may be used to pair players in the group of unassigned players that have been idle or unassigned for the longest time. In this case, the amount of time players have been in the pool of free or unassigned players is compared and the two players with the longest residence time in the pool are paired. However, the process may be modified to block pairing of players for sequential games. Thus, for example, if pairing a first player with the longest time in the pool with a second player having the second longest time in the pool would result in the players playing sequential games against each other, the first player may be paired with a third player having the third longest time in the pool to avoid sequential pairing of the same players.

In different embodiments, a random selection process, for example utilizing a random number or pseudo random number generator, may be used to pair unassigned players. In some embodiments, the random selection process may be modified to block a first player from being paired with a second player against whom he or she has just concluded a game to avoid sequential pairing of the same players. In this case, with or without a random selection process, a first player could possibly be paired against a second player currently engaged in a game with a third player. In this case there may be a short delay before the second player finishes his or her game with the third player. However, it is anticipated that individual games or hands will be time-limited, thereby maintaining any delay to relatively short periods. For example, each player in a poker hand may be required to take action within thirty seconds of a previous action requiring a response. Thus, a player may be required to place a check, fold or bet within thirty seconds of receiving cards or respond to a raise by an opposing player within thirty seconds. Failure to take the required action in the predetermined time may result in forfeiture of the game or hand.

In one embodiment, unpaired or unassigned players may be paired based on the number of wagering units held by the unassigned players. For example, the two players with the lowest number of wagering units in a pool of unassigned players may be paired against each other. The process may be modified to block pairing of players for sequential games. For example, if pairing a first player with the least number of wagering units with a second player having the second smallest number of wagering units would result in the players playing sequential games against each other, the first player may be paired with a third player having the third smallest number of wagering units to avoid sequential pairing of the same players. The process may be adjusted or modified to minimize the amount of time that a player remains unassigned by placing limits on the amount of time a player remains unpaired. For example, if the pairing two players with the lowest number of wagering units would result in a player being inactive for five minutes, the process may be modified to pair the player with the least number of wagering units with the next available player having less than a predetermined number of wagering units.

As participants are eliminated, adjustments to the foregoing methods of pairing the tournament participants may be required. For example, at the end of the tournament, if only a few participants remain, it may not be possible to avoid sequential games between the remaining participants. If only two participants remain, sequential games between the two remaining participants may be required to determine a winner depending, upon the tournament format and rules.

At 324, the game or hand is initiated. As used herein the term "game" may be used to refer to a single hand in a poker game. In the case of a Texas Hold'em tournament, the players are each dealt private cards, followed by a round of betting as described above. The game or hand continues to completion at 326 and the players' accounts (number of wagering units held) are updated. After the players' accounts have been updated, the players' records are checked at 328 to determine if one or both of the players has selected an automatic cash out as described hereinafter. If one or both of the players have selected an automatic cash out and has an equity meeting the selected cash out limit, the player or players will be cashed out of the tournament, e.g. paid his or her equity less any administrative fees, at 330 and the process ends at 332 with the cashed out player or players leaving the tournament.

Similarly, a player electing to leave the tournament at 334 will be cashed out at 330 and the process ends at 332. If one or both of the players are not cashed out and elect to continue play at 334, the process loops back to 322 and each player is paired with an opposing player for the next hand. Since the opposing players will finish the hand at the same time, to avoid pairing the same players, a time delay may be applied before pairing one of the players. For example, if players A and B finish a hand, player A may be paired immediately with an available player while a delay of, for example two to five seconds, may be applied before pairing player B with an available player. In another embodiment, game server 120 may be programmed to block player A from one or more consecutive games against player B. Thus, opponents do not play each other in a traditional elimination format, but rather play against other participants in the tournament at random.

In one embodiment, the tournament may be opened ended with no fixed termination time. In this embodiment, players may enter the tournament at any time by buying into the tournament as described below. Similarly a player may leave the tournament at any time by elimination, e.g. losing all of his or her wagering units, or by settling out of the tournament as described below. Players may also be afforded the opportunity to purchase wagering units during the tournament, for example between hands, to avoid being eliminated or to enable the player to make larger wagers. In this manner, the tournament may continue indefinitely, so long two or more players continue.

In other embodiments, the tournament may be closed ended. In this embodiment, the tournament may be closed to additional players at a predetermined time, with play continuing until all but one of the players have been eliminated. In other embodiments, the tournament may continue until a predetermined end time with the winner or winners being determined by the number of wagering units held at the predetermined end time.

In one embodiment, the players remain anonymous during the tournament in order to prevent collusion. In different embodiments, a player may be assigned a fictitious "table name" when he or she enters the tournament. The "table name" may be changed periodically at predetermined intervals, after a predetermined number of hands or after each hand to prevent identification of the player. The table name may be used to label simulated players 406*a* and 406*b* of FIG. 4.

Figure 5A:
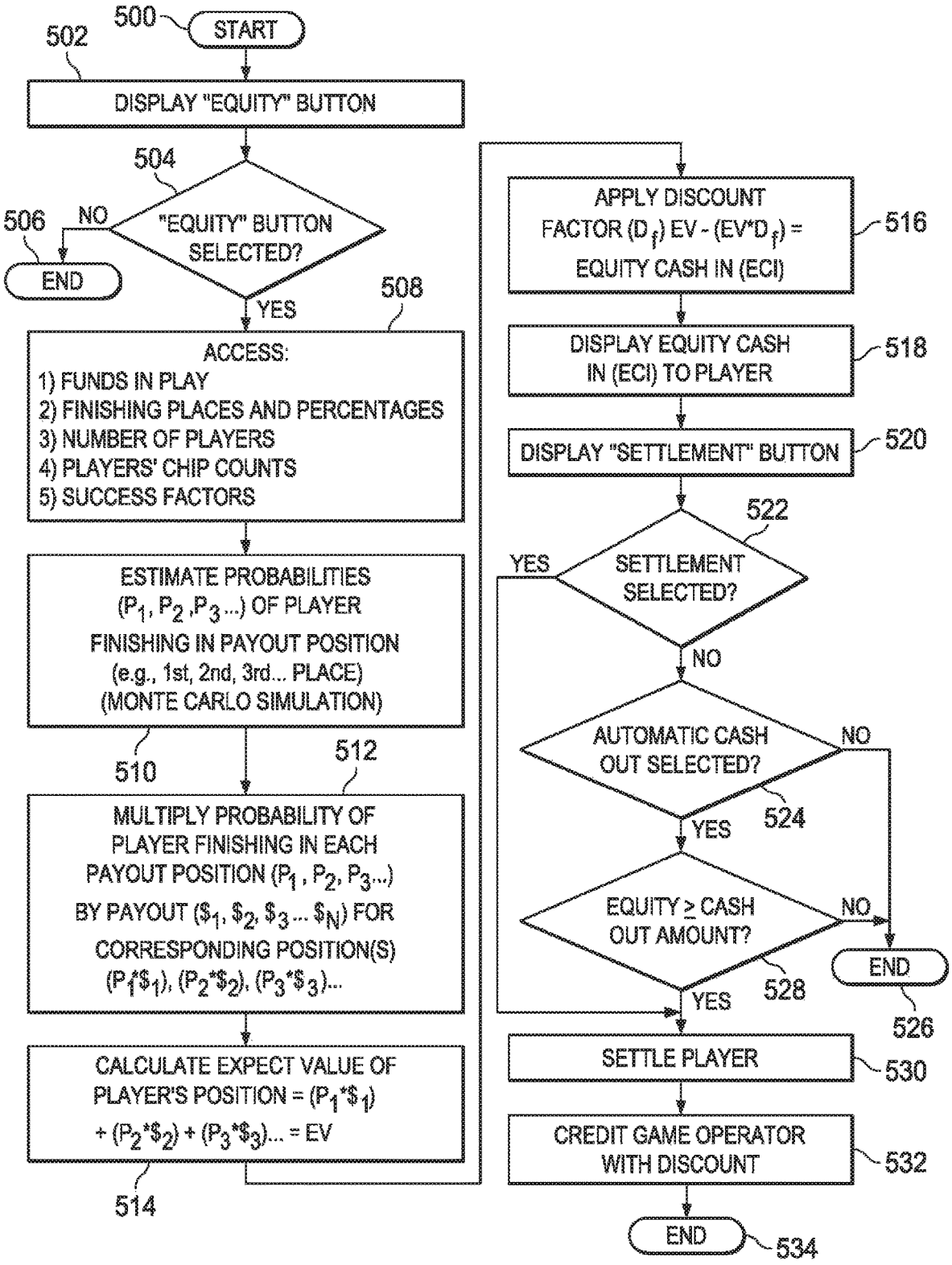
FIG. 5A is a flow chart illustrating one method of calculating a player's equity in a heads up tournament.

FIG. 5A is a flowchart illustrating one method of providing an equity cash-out option during an online poker tournament. The method may also be employed in connection with a heads up game tournament conducted by a game server that is accessed with a plurality of personal communication devices. In other embodiments, the tournament may be conducted with a plurality of networked dedicated video game machines. Although a heads up game tournament as disclosed herein may continue indefinitely, for the purpose of calculating a player's equity, it is assumed that the tournament will end at some point with one or more players having the largest chip counts receiving a payout. It is also contemplated that a player's equity may also be calculated based on a winner-take-all basis.

The process starts at 500 with the conclusion of a poker hand or game during the tournament. At step 502, a player in the tournament may press the "equity" button 418 (FIG. 4) to display his or her equity in the tournament, if the player's equity is not already displayed. If a player elects not to press the "equity" button at step 504, within a predetermined time period, for example, 10 or 15 seconds, the process ends with respect to that player at 506 and the tournament will continue after the remaining players either decline or elect to proceed as hereinafter described.

In order to determine a player's equity, game server 120 accesses or collects the following information at step 508: 1) the total amount of money or funds in play (the prize pot) at the time of the calculation; 2) the number of finishing payout positions and the percentage of the prize pot to be awarded to each finishing position; 3) the number of players in the tournament; 4) each player's chip (wagering unit) count, and optionally, 5) "success factors," (e.g., a number indicative of the player's skill) for players. The optional success factor may be based on a player's performance in the particular tournament, for example the number of and/or size of the hands the player has won in the tournament. Alternatively, the optional success factor may be based on the player's performance e.g. finishing position(s), the amount the player has won or lost in previous tournaments and similar factors. As will be appreciated, the number of players remaining in the tournament, and each player's chip count will change from hand-to-hand during the tournament as may the optional player success factor.

At step 510, game server 120 utilizes an estimate engine 162 to estimate, for each player, the probabilities ($P_1$, $P_2$, $P_3$, . . . ) that the player will place in one of the paying positions ($1^{st}$, $2^{nd}$, $3^{rd}$, . . . ). The estimate engine 162 includes the software, firmware and hardware necessary to conduct the calculations in a timely fashion and in one embodiment, uses a Monte Carlo or modified Monte Carlo simulation to play the tournament to completion a sufficient number of times to provide an estimate to a predetermined desired level of confidence. The estimates may be based upon a sequence of simulated heads up "all-in" events between randomly drawn players. During the simulation, each player is dealt a poker hand at random and the player with the smaller chip stack wagers his entire stack on the outcome of the hand. If the player with the larger cash or chip position wins, the loser's chip stack is added to the winner's, and the loser exits the tournament with a position determined by the number of remaining players.

In the simulation, if the player with the lesser chip position wins the hand, his stack is doubled at the expense of his opponent, as in a regular poker tournament. The tournament simulation continues until all but one of the players is eliminated and estimates of the probabilities of final places of the players in question have been determined. As previously noted, the inputs to run the simulation include the total amount of money or funds in play at the time of the calculation, the number of finishing payout positions and the percentage of the prize pot to be awarded to each finishing position, the number of players in the tournament and each player's chip (wagering unit) count. Optionally, a player's "success factor," e.g., a number indicative of the player's skill level or previous success may be employed in the simulation. If a "player success factor" is considered, it may be used to weigh (increase or decrease) the estimated probability of a player finishing in a paying position.

In order to estimate the "equity" of a given player (the expected value of the player's position), a string of simulations is used to provide an estimated placement distribution P1, P2, . . . Pn, where Pi is the probability of the player finishing in place i. The tournament simulation is repeated a sufficient number of times and the results averaged to obtain an estimated placement distribution with the desired level of confidence. For example, the tournament simulation may be repeated 50, 100, 1000 or a greater number of times.

For each such player, the probability (P1, P2, P3, . . . Pn) of that player finishing in one of the paying positions n is multiplied by the payout ($1, $2, $3, . . . $n) of that position at step 512. The payout of each position is equal to the percentage of the pot to be awarded to the position multiplied by the total amount of money or funds in play at the time of the calculation. For example, if the total of the funds in play at the time of the calculation is $500,000 and the second place award is 20%, the payout of the second position will be calculated as $100,000. In this example, if the probability of a player finishing in second place is 11%, then P2*$2 is $100,000*0.11=$12,100.

Figures 5B, 6:
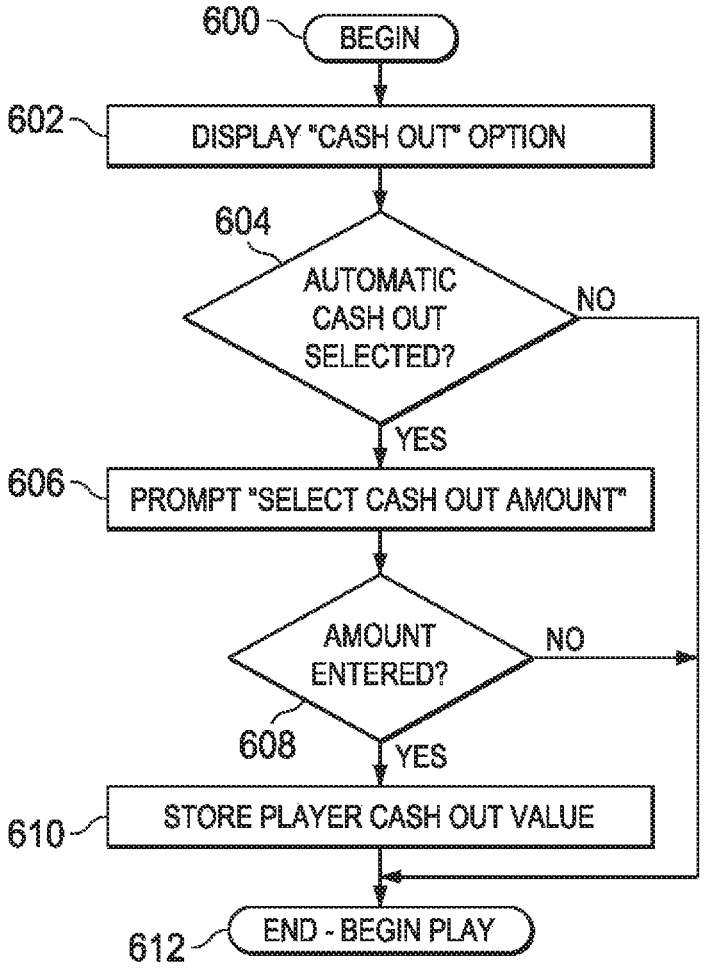
FIG. 5B is a table illustrating one method of calculating a player's equity in a heads up tournament.
FIG. 6 is a flowchart of one method for conducting a heads up game tournament wherein a player may set automatic cash out values.

A player's equity may be determined by multiplying the probability that a player will finish in each one of the paying positions P1, P2, Pn by the payout for that position $1, $2 . . . $n and summing the result. Thus, the player's "equity" or expected value of the player's position is calculated as P1*$1+P2*$2+ . . . +Pn*Sn. For example, if the total number of finishing paying positions is seven, the total of the funds in play at the time of the calculation is $500,000 and the estimated probability of a player finishing in first place is 10% the result is $500,000*0.33*0.10=$16,500.00. This calculation is repeated for each paying position and the results are summed for that player at step 514 to determine an expected value (EV) for the player's position: EV= $((P_1*\$_1)_+(P_2*\$_2)+(P_3*\$_3))$. FIG. 5B is a table illustrating these calculations for a given player. As shown, the expected value (EV) of the player's position may be calculated as $59,750. It will be appreciated that the (EV) of different players will vary, depending upon their respective chip counts and any possible success factors that may be incorporated into the calculation.

In one embodiment, after the expected value (EV) of the player's position is determined, a discount factor ($D_f$) or penalty is applied to the expected value at step 516. For example, the penalty may be 5%, 10%, 15%, or other appropriate percentage or amount, depending upon the number of players remaining in the tournament and the particular rules implemented by the tournament operator. For example, if the discount factor is 10%, an equity cash-out value (ECO) may be calculated as ECO=EV−(EV*0.10). Using the example of FIG. 4, the ECO would be calculated as $59,750−($59,750*0.10)=$53,775. The ECO may be displayed to the player at step 518 along with a "settlement" or "cash out" button 426 (FIG. 4) at step 520 which gives the player the option of withdrawing from the tournament and cashing in his or her position for the equity cash-out value (ECO) at step 522. If the player elects to cash out, the value of the discount or penalty ($5975) may be credited to the tournament operator.

The same method may be used to determine the number of wagering units to be provided to a given player wishing to add or buy additional chips during the course of a tournament or the number of wagering units to be provided to a new player joining the tournament after it has begun. The expected value or equity of the new player's position is estimated on the basis of a new prize pot including the funds added by the new player. The size of the chip stack or number of wagering units received by the new player is determined on the basis of the expected value of his or her position at the time of the new player's buy-in. The new participant's "buy in" does not impact the expected value of the position of the other participants in the tournament insofar as the new participant's position is determined based upon a larger prize pot to be divided by the participants. Similarly, in the case where a given player wishes to add wagering units during the course of a tournament, the player's new equity, based on additional value received from the player and added to prize pot, is estimated and additional wagering units, proportional to the player's new equity, are provided to the player.

In one variation, the foregoing calculations may be performed at the beginning of the tournament or at different stages in a tournament and the results tabulated in a table similar to that shown in FIG. 5B. In this variation, a number of assumptions may be made with regard to the number of remaining players and the number of wagering units held by each player in order to complete such a table. The table may then be used to estimate a player's equity without the need to repeat the above described calculations for each player at the conclusion of each game or hand. If a value, such as the number of wagering units held by each player, falls between the tabulated values, an estimate based upon interpolation between tabulated values may be used. Such an estimate, based upon tabulated values may be used for providing a player with an estimate of his or her equity. In the event that a player chooses to cash out, the above calculations will be performed to provide an equity value that may be used to cash the player out of the tournament.

Turning again to FIG. 5A, if the player selects the ECO cash-out option at step 522, the player is settled or cashed in at step 330. In the example illustrated in FIG. 4, (10% discount factor) the player's account would be credited with $$53,775 after applying a 10% discount factor. After all players have elected or declined the settlement option, the process ends at step 534 and tournament play resumes. The foregoing calculations allow for a player to cash out without affecting the equity of the remaining players except to the extent that a penalty or part of any penalty assessed to a player who withdraws while the tournament is in progress is added to the existing prize pool. In this case, the remaining respective equities of the remaining players are increased proportionately.

If a player does not elect to settle after being informed of his or her equity at step 522, the player's record or log will be checked at step 524 to determine whether the player has selected the automatic cash out option as described hereinafter. If the player did not select the automatic cash out option, the process ends at step 526 and the tournament will continue after the remaining tournament players either decline or elect to proceed with the settlement option. If the player did select the cash out option, the player's equity will be compared to a stored automatic cash out amount selected by the player at step 608 (FIG. 6). If the player's equity is determined to be greater than or equal to the player's previously selected automatic cash out value, the player is settled or cashed out at step 530 and the value of any penalty or discount factor may be credited to the game or tournament operator at step 532.

In one embodiment, tournament players may also be provided with the opportunity to set an automatic "cash out" value such that when the player's equity reaches the player's pre-set value, the player is automatically cashed out of the tournament. For example, a player may buy into a tournament with $500.00 and decide that he or she will cash out if his or her equity reaches $1000.00. In one embodiment, the player may be provided with the option of pre-setting a $1000.00 limit. If the player is successful in accumulating $1000.00 dollars in equity, he or she will automatically be cashed out of the tournament. Alternatively, a player may elect to be automatically cashed out if his or her equity drops to a preselected level. For example, a player buying into a tournament with $500.00 may decide that he or she will cash out if his or her equity falls to, for example, $300.00. In this embodiment, display 400 (FIG. 4) may include an "automatic cash out" button 428 that prompts a players to enter an equity value at which he or she will be "cashed out" of the tournament. In different variations, a player may elect to choose an automatic cash out after the tournament has begun.

FIG. 6 is a flow chart illustrating a method whereby a tournament player selects an automatic cash out option. The automatic cash out option provides a player to set predetermined limits for his or her loss or gain in the tournament. If one of the predetermined limits is reached or exceeded the player may be automatically cashed out of the tournament. This feature allows a player an opportunity to limit his or her losses by withdrawing from the tournament before he or she has lost more than a preselected amount. Alternatively the feature gives the player an opportunity "get out ahead of the game" if his or her winnings reach a preselected value.

The process begins at step 600 when the player elects to join the tournament. At step 602, an "automatic cash out" button 428 (FIG. 4) or similar indicia is displayed to participant, prompting the participant to select the automatic cash out option. If the player elects the option at step 604, the player is prompted to select an equity stop value or values at step 606 at which the participant will be automatically cashed out of the tournament. In one variation, the player may select an upper and lower limit. For example, a player may decide that he or she will leave the tournament if his or her equity in the tournament drops to a lower cash out value or limit of $500 or increases to an upper cash out value or limit of $1500.

Alternatively, if the participant enters an automatic cash out value or values, at step 610 the value or values are stored with the player for comparison with the participant's equity at selected intervals, for example, at the end of each hand or each game played in the tournament (FIG. 5A, step 528). The process ends at step 612 with the initiation of tournament play.

In different embodiments, a participant may select an option that alerts the participant that he or she has reached preselected cash out limit rather than automatically cashing the player out of the tournament. For example, a player that pays a $1000 entry fee may decide that he or she will leave the tournament if his or her equity in the tournament drops to $500 or increases to $1500. In this variation, the player may enter the $500 and $1500 values at step 608 and then chooses between an "alert" option and an "automatic cash out" option. If the participant selects the "alert" option, he or she will be notified when his or her equity drops to equal to or less than $500 or increases to a value equal to or greater than $1500. The player may then choose to cash out of the tournament or continue to play. Alternatively, if the player selects the "automatic cash out" option, he or she will be automatically cashed out of the tournament if his or her equity drops to $500 or less or if his or her equity reaches a value equal to or greater than $1500. If the participant wishes to continue to play after being cashed out, he or she will then have to re-enter the tournament.

In one adaptation, a tournament participant may be afforded the opportunity to receive a partial cash out of his or her equity or alternatively to increase his or her equity with additional funds. In the case where the casino style tournament game is poker, the participant may therefore increase the size of his or her chip stack by "purchasing" additional equity or alternatively, give up a portion of his or her chip stack in exchange for a partial cash out of his or her equity. In the case of a partial cash out, or equity "buy in" the calculations described above in connection with FIGS. 5A and 5B may be used to determine the appropriate value of a partial cash out. For example, the equity associated with a position of 500 wagering units may be calculated and used as the basis for a partial cash in of a user. The same calculation may be used to determine the appropriate dollar value of an equity buy in of 500 wagering units.

Although the preferred embodiment has been described in detail, it should be understood that various changes, substitutions and alterations can be made therein without departing from the spirit and scope of the invention as defined by the appended claims.

What is claimed is:

1. A method of simulating a heads up gaming tournament utilizing at least one game server, the method comprising:

receiving value from a plurality of participants each using a personal communication device to participate in a tournament, whereby each participant is provided with a plurality of wagering units enabling the participant to participate in the tournament by playing one or more heads up games with another participant, each using the personal communication devices to play, wherein the personal communication devices are configured to show a display including a user interface provided by the game server;

initiating, with the game server, the heads up game with a game state and transmitting the game state to the personal communication device of each participant for display;

displaying an equity display object and a wagering unit display object in the user interface of the display of the personal communication device of each participant, wherein the equity display object apprises each participant of a current equity of the participant, and wherein the wagering unit display object apprises each participant of a current wagering balance of the participant;

updating, on the user interface of the display for a participant, the equity display object and the wagering unit display object based on an updated game state;

receiving, from one or more participants, a settlement request and withdrawing the participant from the tournament based on the settlement request; and receiving, from one or more participants, a cash out limit value whereby an equity of a given participant is determined after each game and if the equity of the given participant reaches the cash out limit, removing the given participant from the tournament and providing the given participant removed from the tournament the equity of the given participant, wherein the heads up game is poker and wherein participants are re-paired after each hand.

2. The method of claim 1, further comprising placing, with the game server, unpaired participants in a pool of unpaired participants, blocking pairing of participants that have been paired to play a heads up game in their most recently played game, comparing, with the game server, a first amount of time spent by each unpaired participant in the pool of unpaired participants with a second amount of time spent by each of other unpaired participants in the pool of unpaired participants, and pairing at least a first participant and a second participant of the unpaired participants that are not blocked and have a greatest amount of time in the pool of unpaired participants to play a heads up game.

3. The method of claim 2, wherein the first participant of the unpaired participants and the second participant of the unpaired participants are the unpaired participants in the pool of unpaired participants with a least number of wagering units.

4. The method of claim 2, wherein the first participant of the unpaired participants and the second participant of the unpaired participants are the unpaired participants in the pool of unpaired participants with a greatest number of wagering units.

5. The method of claim 2, further comprising:

receiving, with the game server, a first input from the first participant in response to the game state, the first input requiring a response from the second participant; and receiving, with the game server, a second input from the second participant in response to the first input.

6. The method of claim 5, further comprising:

determining, with the game server, an outcome of the heads up game; and updating, with the game server, a number of wagering units held by the first and second participant based upon the determined outcome of the heads up game.

7. The method of claim 1, further comprising receiving, between games, additional value from a given participant, whereby the given participant is provided with additional wagering units without affecting an equity of the participants participating in the tournament.

8. The method of claim 1, further comprising eliminating participants from the tournament that have no wagering units remaining.

9. The method of claim 8, further comprising:

determining one or more winners of the tournament; and awarding the winner or winners a prize.

10. A system for simulating a heads up gaming tournament, the system comprising:

at least one game server including at least one processor and a communication interface, where the at least one processor of the at least one game server is configured to:

communicate, via the communication interface, with one or more personal communication devices each associated with a participant;

receive value from the one or more personal communication devices to participate in a tournament, whereby each participant is provided with a plurality of wagering units enabling the participant to participate in the tournament by playing one or more heads up games with another participant, each using one of the one or more personal communication devices to play, wherein the one or more personal communication devices are configured to show a display including a user interface provided by the game server;

initiate the heads up game with a game state;

transmit, via the communication interface, the game state to each of the one or more personal communication devices for display;

displaying an equity display object and a wagering unit display object in the user interface of the display of the one or more personal communication devices of each participant, wherein the equity display object apprises each participant of a current equity of the participant, and wherein the wagering unit display object apprises each participant of a current wagering balance of the participant;

updating, on the user interface of the display for a participant, the equity display object and the wagering unit display object based on an updated game state;

receiving, from one or more participants, a settlement request and withdrawing the participant from the tournament based on the settlement request; and receiving, from one or more participants, a cash out limit value whereby an equity of a given participant is determined after each game and if the equity of the given participant reaches the cash out limit, removing the given participant from the tournament and providing the given participant removed from the tournament the equity of the given participant, wherein the heads up game is poker and wherein participants are re-paired after each hand.

11. The system of claim 10, wherein the at least one processor is further configured to:

place unpaired participants in a pool of unpaired participants;

block pairing of participants that have been paired to play a heads up game in their most recently played game;

compare, with the game server, a first amount of time spent by each unpaired participant in the pool of unpaired participants with a second amount of time spent by each of other unpaired participants in the pool of unpaired participants; and pair at least a first participant and a second participant of the unpaired participants that are not blocked and have a greatest amount of time in the pool of unpaired participants to play a heads up game.

12. The system of claim 11, wherein the first participant of the unpaired participants and the second participant of the unpaired participants are the unpaired participants in the pool of unpaired participants with a least number of wagering units.

13. The system of claim 11, wherein the first participant of the unpaired participants and the second participant of the unpaired participants are the unpaired participants in the pool of unpaired participants with a greatest number of wagering units.

14. The system of claim 11, wherein the at least one processor is further configured to:

receive, with the game server, a first input from the first participant in response to the game state, the first input requiring a response from the second participant; and receive, with the game server, a second input from the second participant in response to the first input.

15. The system of claim 14, wherein the at least one processor is further configured to:

determine an outcome of the heads up game; and update a number of wagering units held by the first and second participant based upon the determined outcome.

16. The system of claim 10, wherein the at least one processor is further configured to receive, between games, additional value from a given participant, whereby the given participant is provided with additional wagering units without affecting an equity of the participants participating in the tournament.

17. The system of claim 10, wherein the at least one processor is further configured to eliminate participants from the tournament that have no wagering units remaining.

18. The system of claim 17, wherein the at least one processor is further configured to:

determine one or more winners of the tournament; and award the winner or winners a prize.

* * * * *